United States Patent [19]

Graham

[11] Patent Number: 4,807,509

[45] Date of Patent: Feb. 28, 1989

[54] ELECTROLUMINESCENT FRET GRID FOR STRINGED INSTRUMENTS

[76] Inventor: John F. Graham, 102 Marabou Pl., Woodlands, Tex. 77380

[21] Appl. No.: 69,114

[22] Filed: Jul. 2, 1987

[51] Int. Cl.[4] ..... G10D 3/06; G10G 1/02

[52] U.S. Cl. ..... 84/314 R; 84/485 R

[58] Field of Search ..... 84/314 R, 477 R, 478, 84/485 R

[56] References Cited

U.S. PATENT DOCUMENTS

| | | | |
|---|---|---|---|
| 2,788,699 | 4/1957 | Pipkin | 84/485 R |
| 3,403,591 | 10/1968 | Weitzner | 84/485 |
| 3,845,686 | 11/1974 | Salvo | 84/314 X |
| 3,854,370 | 12/1974 | Sapinski | 84/485 |
| 3,943,815 | 3/1976 | Gilbert | 84/314 X |
| 3,978,756 | 9/1976 | Feldman | 84/314 X |
| 3,978,757 | 9/1976 | Johnson, Jr. et al. | 84/314 X |
| 4,080,867 | 3/1978 | Ratanangsu | 84/477 R |
| 4,286,495 | 9/1981 | Roof | 84/314 R |
| 4,545,281 | 10/1985 | Habicht | 84/478 X |
| 4,589,324 | 5/1986 | Aronstein | 84/477 R X |

*Primary Examiner*—W. B. Perkey

*Attorney, Agent, or Firm*—Pravel, Gambrell, Hewitt, Kimball & Krieger

[57] ABSTRACT

A musical training device for stringed instruments having a neck with a fret board includes a fret support plate that extends over the instrument neck and includes regularly spaced transverse raised frets defining therebetween spaces receptive of the musician's fingers. A matrix of thin lights displayed upon the fret board are contained within the fret board and include electroluminescent flat light displays viewable from a wide angle and under ambient lighting conditions and capable of indicating the actual musical note of each position at each position, each comprising at least in part a phosphor layer and an electrode for applying an electric field across the phosphor layer.

9 Claims, 2 Drawing Sheets

ELECTROLUMINESCENT FRET GRID FOR STRINGED INSTRUMENTS

BACKGROUND OF THE INVENTION

The present invention relates to musical instrument training devices, particularly for stringed instruments and more particularly to an improved fret board training device that includes a matrix of thin lights displayed within the fret board, consisting of a light matrix of electroluminescent flat panel displays which are viewable from a wide angle and under ambient lighting conditions wherein the electroluminescent display (or "ELD") uses a layer of phosphor material and electrode layers with the electrodes supplying an electric field across the phosphor layer.

There are a number of different stringed instruments which have a larger sound box or body with a long narrow neck attached thereto and include a plurality of, for example, 6–12 strings and a number of frets or transverse raised ribs across the neck at regularly spaced intervals. Such instruments are, for example, the guitar, banjo, and the like.

The guitar is typically played by depressing one or more of the strings at certain locations between the frets to shorten the string and thus produce various sounds that are pleasing to the listener. Thus, a user must be able to visually locate a particular and precise fret and string location on the instrument and correctly depress that string at that fret position to produce a particular musical chord or note.

Learning to play the guitar means learning the particular locations for strings and frets as well as an ability to quickly and easily depress the proper string location. The guitar is unmarked with any indicia that would be a clue to the student, thus the learning process is difficult without some visual aid.

One solution to this problem has been to provide a booklet having a diagram corresponding to the guitar chord positions so that the student can look at the book and then visually place his or her fingers at the particular location on the instrument that corresponds to a particular chord or note. This particular practice of teaching is awkward and cumbersome because the student must repeatedly change the position of his head in order to look at either the guitar or the booklet having the instructions. This problem has been discussed in previous U.S. patents, for example, U.S. Pat. No. 4,286,495 issued to John Roof and entitled "Musical Instrument Training Device." The Roof '495 patent offers a possible solution to the above-described problems by providing an electrical device which helps train a student to play a stringed instrument and includes a group of visual indicators mounted on the neck of a fret board and each indicator being immediately beneath and in registry with a particular string and fret of the instrument so as to identify therewith. The Roof '495 patent further provides a second group or plurality of visual indicators mounted on the fret board adjacent the sounding hole in spaced relationship to the first plurality of visual indicators and each one is associated with a particular string to be strummed for a particular musical chord. Switches are provided for selection of musical chords and are operably connected to a diode matrix for energizing selected ones of the visual indicators in the first and second groups whereby the energized visual indicator pattern of the first group represents finger placement loctions along the neck of the fret board for a selected musical chord and the energized visual indicator pattern or the second group represents appropriate strings to be strummed associated with the selected musical chord.

The Roof '495 patent uses light emitting diodes or LEDs which cannot be visualized unless the line of sight is at or very close to a line perpendicular to the plane of the viewing surface. This is a particular problem with guitar players because the guitar is usually placed against the body of the musician. The front surface of the guitar as well as the front face of the fret board is directed away from the musician as well as away from the musician's eyes. Thus, normally the musician must bend over only slightly in order to see the fret board. Nonetheless, the fret board is normally viewed at wide angles to an imaginary line perpendicular to the plane of the viewing surface (e.g., 60–80 degrees). This necessitates a total accessible viewing angle up to 160 degrees. Otherwise, the guitar player would need to lay the guitar virtually flat against his or her lap or against a table in order to see the light display which would be an uncomfortable and unnatural position considerably hindering the playability of the instrument.

Several other patents have been issued which are directed to the problem of a visual device for teaching the playing of a musical stringed instrument. Examples of other patents include the Pipkin U.S. Pat. Nos. 2,788,699, the Sapinski 3,854,370, the Johnson 3,978,757, the Gilbert 3,943,815, the Ratanangsu 4,080,867, and the Habicht 4,545,281.

These patents do not solve the problem of providing an easily viewable matrix of thin lights displayed within the fret board of a guitar and having a wide angle viewing area under ambient lighting conditions.

Electroluminescent displays (ELDs) are commercially available. ELDs are discussed, for example, in the March 1985 issue of BYTE magazine with appended bibliography and references.

GENERAL DISCUSSION OF THE PRESENT INVENTION

The present invention solves these prior art problems and shortcomings by providing an improved musical training device for stringed instruments which have a neck and a fret board thereon. The apparatus includes a fret support plate that extends substantially over the instrument neck and includes regularly spaced transverse raised frets defining depress spaces receptive of a musician's fingers which selected strings to form preselected musical chords. A matrix of thin lights is displayed within the fret board and contained entirely within. The light matrix includes electroluminescent flat panel displays viewable from a wide angle and under ambient lighting conditions and comprising at least in part a phosphor layer and an electrode for applying an electric field across the phosphor layer. The electroluminescent flat panel display preferably includes multiple layers of at least a phosphor layer, an insulator layer, and a pair of electrodes positioned above and below the phosphor layer. The apparatus preferably includes a light display that has a flat uninterrupted outer surface receptive of the user's fingers. The apparatus provides a light matrix which is viewable from a very large viewing angle of approximately 160°. In the preferred embodiment, there are a pair of insulative layers positioned above and below the phosphor layer. In the preferred embodiment, the fret board and composite light matrix are arranged in parallel planes and positioned atop the neck of the stringed instrument. The light matrix is preferably a matrix of lights arranged in longitudinal rows corresponding to the number of instrument strings and in a number of transverse rows corresponding to the number of frets. The apparatus can include a selection generating computer, for example, for lighting preselected lights so that certain desired chord positions can be designated on the instrument neck under selected strings and between selected frets.

BRIEF DESCRIPTION OF THE DRAWINGS

A better understanding of the invention can be had when the detailed description of a preferred embodiment set forth below is considered in conjunction with the drawings, in which.

DETAILED DESCRIPTION OF THE PREFERRED EMBODIMENTS

Figure 1:
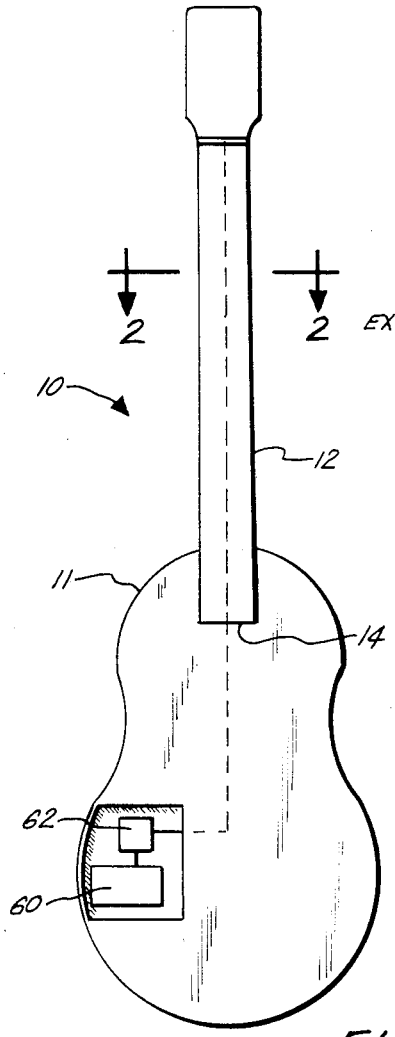
FIG. 1 is a top view of the preferred embodiment of the apparatus of the present invention.
Figure 2:
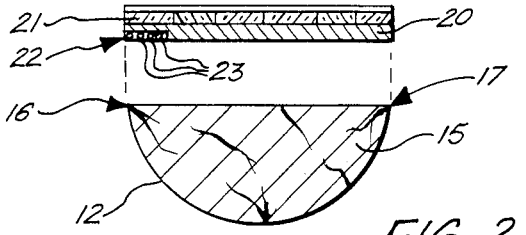
FIG. 2 is a sectional view taken along lines 2—2 of FIG. 1.
Figure 3:
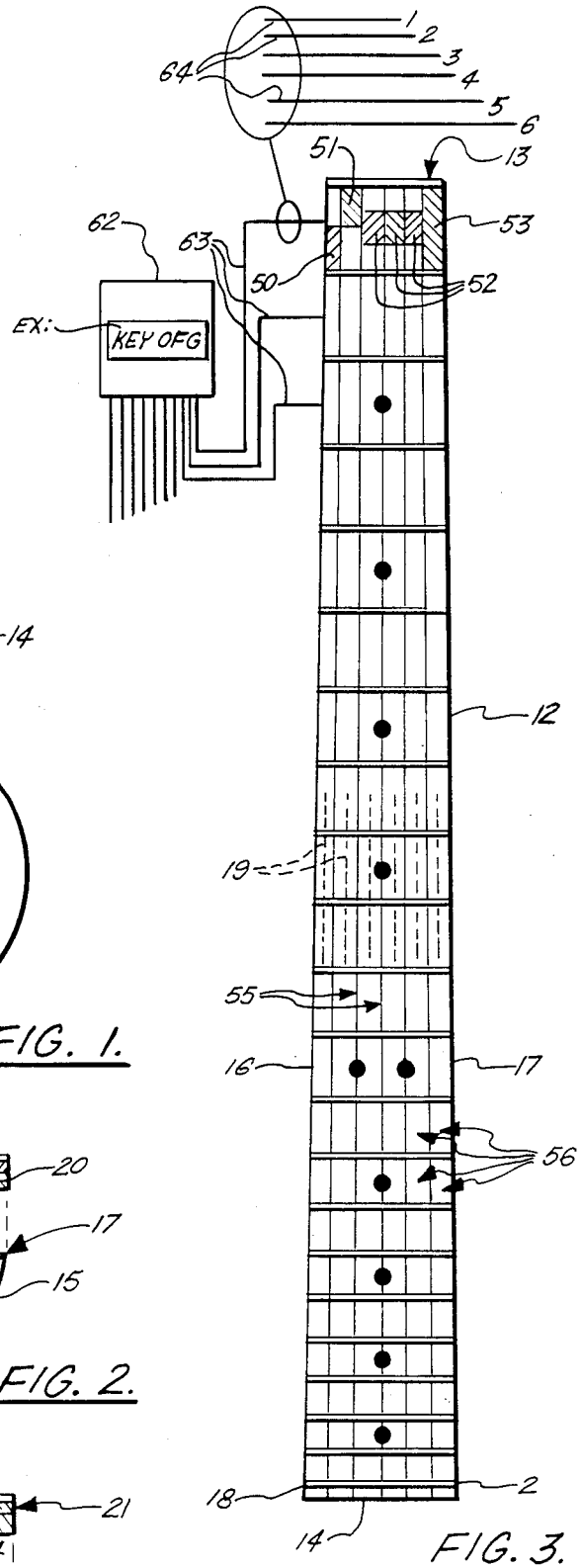
FIG. 3 is a partial plan view of the preferred embodiment of the apparatus of the present invention illustrating the neck and fret portions thereof as well as the electroluminescent display portion.

FIGS. 1-3 illustrate generally the preferred embodiment of the apparatus of he present invention designated generally by the numeral 10. In FIG. 1, there can be seen a guitar body 11 includes an elongated neck portion 12 that extends between neck end portions 13, 14 and which includes neck sides 16, 17 with a plurality of spaced apart transverse frets 18 extending between end portions 13, 14. A plurality of longitudinally extending strings 19 extend from end portion 13 to end portion 14. The aforementioned construction of guitar 10 is conventional and known in the art.

Figure 2A:
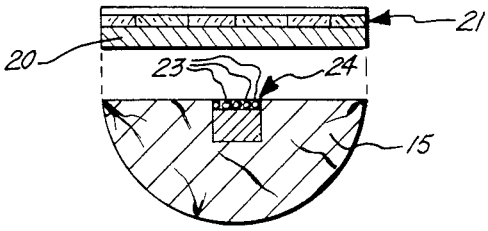
FIG. 2A is another sectional view taken along lines 2—2 of FIG. 1 illustrating an alternate wiring access of the apparatus of the present invention.

FIGS. 2 and 2A illustrate a transverse section of guitar neck 12 including a structural neck member 15 and a fret board 20 placed thereupon extending substantially across the upper surface of structural neck portion 15 between end portions 13, 14 and between sides 16, 17. Fret board 20 supports a matrix of electroluminescent displays, the matrix being designated generally by the numeral 21 in FIGS. 2 and 2A. In the preferred embodiment of FIG. 2, the fret board 20 includes an elongated longitudinal groove 22 which can carry a plurality of electrical conduits 23 for supplying electrical energy to each of the plurality of electroluminescent displays contained in the matrix 21 as shown in FIG. 2.

In FIG. 2A, the structural neck 15 includes a longitudinal groove 24 that carries a plurality of conduits 23 for transmitting electricity to the plurality of electroluminescent displays (ELDs) contained in the matrix 21 of ELDs.

Figure 4:
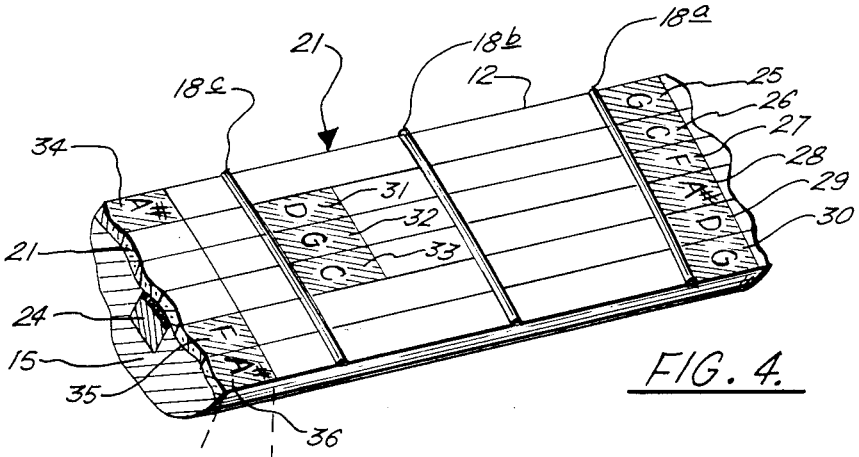
FIG. 4 is a fragmentary perspective view of the preferred embodiment of the apparatus of the present invention.
Figure 5:
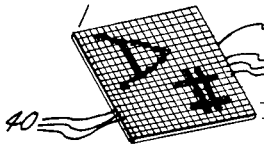
FIG. 5 is a fragmentary view of the preferred embodiment of apparatus of the present invention designating a single electroluminscent display module.
Figure 5A:
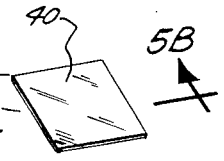
FIG. 5A is another fragmentary perspective view of the preferred embodiment of the apparatus of the present invention illustrating a single pixel of an electroluminscent display as used therein.
Figure 5B:
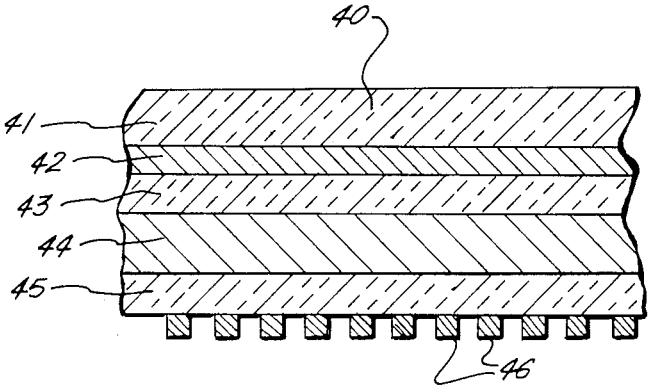
FIG. 5B is a sectional view taken along lines 5B—5B of FIG. 5A.

FIG. 4 illustrates more particularly the matrix 21 of electro-luminescent displays in a fragmentary view which shows a portion of neck 12. In FIG. 4, three frets 18A, 18B, 18C are shown which represent respectively the third, fourth and fifth fret of a guitar. A plurality of position indicators 25-36 are shown in the example of FIG. 4 including single position indicator 36 which is enlarged to show that it comprises a matrix of smaller pixels 40 with a single pixel being further illustrated in FIG. 5A. FIG. 5B is a sectional view illustrating the construction of a particular pixel which forms a matrix for a single ELD position indicator 36. In FIG. 5B, the particular small pixel 40 includes a plurality of layers, including an upper glass 41, a second layer 42 which is a top electrode, a third layer which is an insulator 43, a fourth layer, phosphor 44, a fifth layer insulator 45, and a final layer 46 which is a bottom electrode. Thus, FIG. 5B illustrates a cross-section of one typical pixel of the ELD or the electroluminescent display. The construction shown in FIG. 5B is merely one combination of sandwiching or layering of materials to form the electro-luminescent displays as used in the apparatus of the present invention.

The above construction provides individual electroluminescent display panels 25-36 which are lighted in FIG. 4. It should be understood, however, that electroluminescent display panels such as 36 in FIG. 5 would be positioned in an overall matrix covering the entire area between guitar neck end portions 13, 14 and extending from side 16 to side 17 of neck 12. Thus, each position indicator continues between every fret and over the entire board and also between each of the strings but centered under each string. An indicator may, for example, partially span between frets or be positioned adjacent one fret as illustrated in FIG. 3. In FIG. 3, a number of different illustrative ELD positions are shown including position 50 which is adjacent one fret while position 51 is adjacent another fret while the positions 52 are centered between frets while the position 53 is a position indicator which extends completely between two frets. The longitudinal lines 55 are longitudinal lines that in combination with frets 18 define the matrix which will be covered with ELD positions. Thus, the matrix is defined by longitudinal lines 55 and transverse lines defined by the frets 18. This produces a plurality of generally rectangular spaces 56 which extend between end portions 13, 14 and from side 16 to side 17 of neck 12. The individual electroluminescent displays within each of the rectangles 56 is thus illustrated by the positions 50-53 in FIG. 3.

Guitar 10 can also include a power pack 60 powered by batteries, for example, and/or an alternating current power source such as a wall plug. A computer control 62 could be provided, for example, for transmitting like display information to the matrix so that particular lights could be illuminated at desired times and durations. Minute wires or conduit would be transmitted from the power source to each position indicator or ELD and a preferably interchangeable computer chip would be provided to the electronic brain 62 so that a preselected program of like display could be used. This would insure a virtually limitless supply of training material for the student. In FIG. 3, the conduit lines 63 are illustrative of small conduits having, for example, a plurality of six individual electric lines 64 for supplying electricity to each individual ELD position indicator such as the position indicators 50–53 in FIG. 3 as between a particular pair of frets 18. Similarly, conduits 63 each having six individual lines 64 would be supplied to each set of six ELD indicators as between a particular pair of frets.

The foregoing description of the invention is illustrative and explanatory thereof, and various changes in the size, shape and materials, as well as in the details of the illustrated construction may be made without departing from the spirit of the invention.

What is claimed as invention is:

1. A musical training device for stringed instruments having a neck with a fret board and multiple strings comprising:

a. a fret support plate extending substantially over the instrument neck and including regularly spaced transverse raised frets defining therebetween spaces receptive of a musician's fingers and selected strings to form preselected musical chords;

b. a matrix of thin lights displayed upon the fretboard in multiple separate positions of strings and frets, each light comprising a generally rectangular area carrying a note indicia thereon; and c. the light matrix including electroluminescent flat panel displays carrying said note indicia thereon and viewable from a wide angle and under ambient lighting conditions, and comprising at least in part a phosphor layer and electrode means for applying an electric field across the phosphor layer.

2. The apparatus of claim 1 wherein the electroluminescent flat panel display includes multiple layers of at least a phosphor layer, an insulator layer, and a pair of electrodes, positioned above and below the phosphor layer.

3. The apparatus of claim 1 wherein the light display has a flat uninterrupted outer surface receptive of the user's fingers.

4. The apparatus of claim 2 wherein the light matrix is viewable from a viewing angle of approximately one hundred sixty degrees (160°).

5. The apparatus of claim 2 wherein there are a pair of insulative layers positioned above and below the phosphor layer.

6. The apparatus of claim 1 wherein fretboard and light matrix are arranged in parallel planes, and positioned atop the neck of the stringed instrument.

7. The apparatus of claim 2 wherein the light matrix is a matrix of lights arranged in longitudinal rows corresponding to the number of instrument strings and in a number of transverse rows corresponding to the number of frets, and each light is generally rectangular and abuts and adjacent rectangular light and carries said note indicia that can display a musical note.

8. The apparatus of claim 7 further comprising selection means for lighting preselected lights so that certain desired chord positions can be designated on the instrument neck under selected strings and between selected frets.

9. The apparatus of claim 8 further comprising the means of indicating alphabetic characters to indicate the actual musical note of each position via the use of individual pixels.

* * * * *